US009372039B1

(12) United States Patent
Russo

(10) Patent No.: US 9,372,039 B1
(45) Date of Patent: Jun. 21, 2016

(54) FIREARM IMPINGEMENT BLOCK WITH ADJUSTABLE GAS FLOW CONTROL MEMBER

(71) Applicant: Carmelo Russo, Port Richey, FL (US)

(72) Inventor: Carmelo Russo, Port Richey, FL (US)

( * ) Notice: Subject to any disclaimer, the term of this patent is extended or adjusted under 35 U.S.C. 154(b) by 0 days.

(21) Appl. No.: 14/741,395

(22) Filed: Jun. 16, 2015

(51) Int. Cl.
*F41A 5/28* (2006.01)

(52) U.S. Cl.
CPC ..... *F41A 5/28* (2013.01)

(58) Field of Classification Search
CPC ..... F41A 5/26; F41A 5/28
USPC ..... 89/193
See application file for complete search history.

(56) References Cited

U.S. PATENT DOCUMENTS

2012/0167757 A1* 7/2012 Gomez ..... F41A 5/28 89/193
2014/0060312 A1* 3/2014 Ruck ..... F41A 5/28 89/193

FOREIGN PATENT DOCUMENTS

GB 739289 * 4/1958

* cited by examiner

*Primary Examiner* — Stephen M Johnson
(74) *Attorney, Agent, or Firm* — Gulf Coast Intellectual Property Group

(57) ABSTRACT

A firearm impingement apparatus that includes a gas flow control member that is operable to provide controlled incremental adjustment of gas flow within the gas block of the firearm impingement apparatus. The firearm impingement apparatus includes a gas block having a port line with an intersecting channel. Rotatably secured within the intersecting channel is a gas flow control member. The gas flow control member includes a first end, a second end and a shaft intermediate thereto. The shaft includes at least three planar sides. A keeper is secured within a mounting member and is positioned such that a portion thereof is biased against the shaft. The keeper is planar in manner and is operable to provide controlled rotation of the gas flow control member within the channel. Further the keeper functions to maintain the position of the gas flow control member.

2 Claims, 2 Drawing Sheets

FIREARM IMPINGEMENT BLOCK WITH ADJUSTABLE GAS FLOW CONTROL MEMBER

CROSS REFERENCE TO RELATED APPLICATION

This application is a continuation-in-part application of U.S. patent application Ser. No. 14/588,999, titled, FIREARM IMPINGEMENT SYSTEM HAVING ADJUSTABLE GAS BLOCK, filed on Jan. 5, 2015 is herein incorporated for reference.

FIELD OF THE INVENTION

The present invention relates generally to firearms, more specifically but not by way of limitation, rifle impingement systems, both direct gas and gas piston systems wherein the impingement block of the present invention includes an adjustable gas flow control member operable to control the flow of gas directed into and outwards from the impingement block.

BACKGROUND

Rifles such as but not limited to the AR15 utilize impingement systems to cycle the bolt carrier during the firing process. As is known in the art, there are two types of impingement systems. A direct gas impingement system is operably coupled to the barrel of the rifle and includes a port that is operably coupled to the barrel chamber and a gas tube adjacent to the barrel. A portion of the gas created during the firing of a round escapes into the port and is routed back to the bolt carrier, which facilitates the rearward movement thereof. The alternative style of impingement system is a gas piston impingement system. The gas piston impingement system also includes a port that is operably coupled to the barrel but leads to a piston chamber. The piston chamber contains a piston head wherein the piston head includes a piston rod extending therefrom having an end adjacent to the bolt carrier. During the firing process a portion of the gas is directed from the barrel and into the piston chamber which drives the piston rod rearward towards the bolt carrier in order to facilitate the movement thereof.

One problem with the current impingement systems mentioned herein is the continuous introduction of carbon-laden gas into either the gas tube and firing chamber or the piston chamber. As rounds are fired the accumulation of carbon and other contaminants build up in various areas of the firearm and reduce the effectiveness of its components. Without regular cleaning this can lead to the misfiring or jamming of the rifle during the shooting process.

Another problem with existing impingement systems is there lack of gas control. Both existing types of impingement systems utilize a method of controlling the gas flow from the barrel into the port that controls the input flow of gas into the gas block port of the impingement block. Utilization of this technique results in excess pressure on the impingement system block and excessive heat build-up. This technique further causes flow blow-back into the barrel and thus creating a need for more frequent cleaning of the barrel. This increases the wear on the component and ultimately leads to the early failure thereof.

Accordingly, there is a need for an impingement system for a firearm that is operable to control the gas flow into the impingement block so as to eliminate contaminant build-up in other areas of the firearm and reduce the heating of the impingement block so as to improve the overall performance of the firearm. Additionally, it is desired to have an impingement gas block that utilizes an adjustable gas flow control member that provides stepped control feedback to the user so as to more precisely calibrate the adjustable gas flow control member.

SUMMARY OF THE INVENTION

It is the object of the present invention to provide an impingement gas block for a firearm that includes a gas block having an adjustable gas flow control member therein.

Another object of the present invention is to provide an impingement gas block for a firearm wherein the adjustable gas flow control member includes a first end and a second end with a shaft intermediate the first end and second end.

A further object of the present invention is to provide an impingement gas block for a firearm wherein the shaft of the adjustable flow control member has at least three sides.

An additional object of the present invention is to provide an impingement gas block for a firearm wherein impingement block further includes a mounting member being adjacent to the first end of the adjustable gas flow control member.

Yet a further object of the present invention is to provide an impingement gas block for a firearm that further includes a keeper wherein the keeper includes a first end and a second end and the keeper being operable to bias against the shaft of the adjustable gas flow control member.

Another object of the present invention is to provide an impingement gas block for a firearm wherein keeper is removably secured to the mounting member with a fastener.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
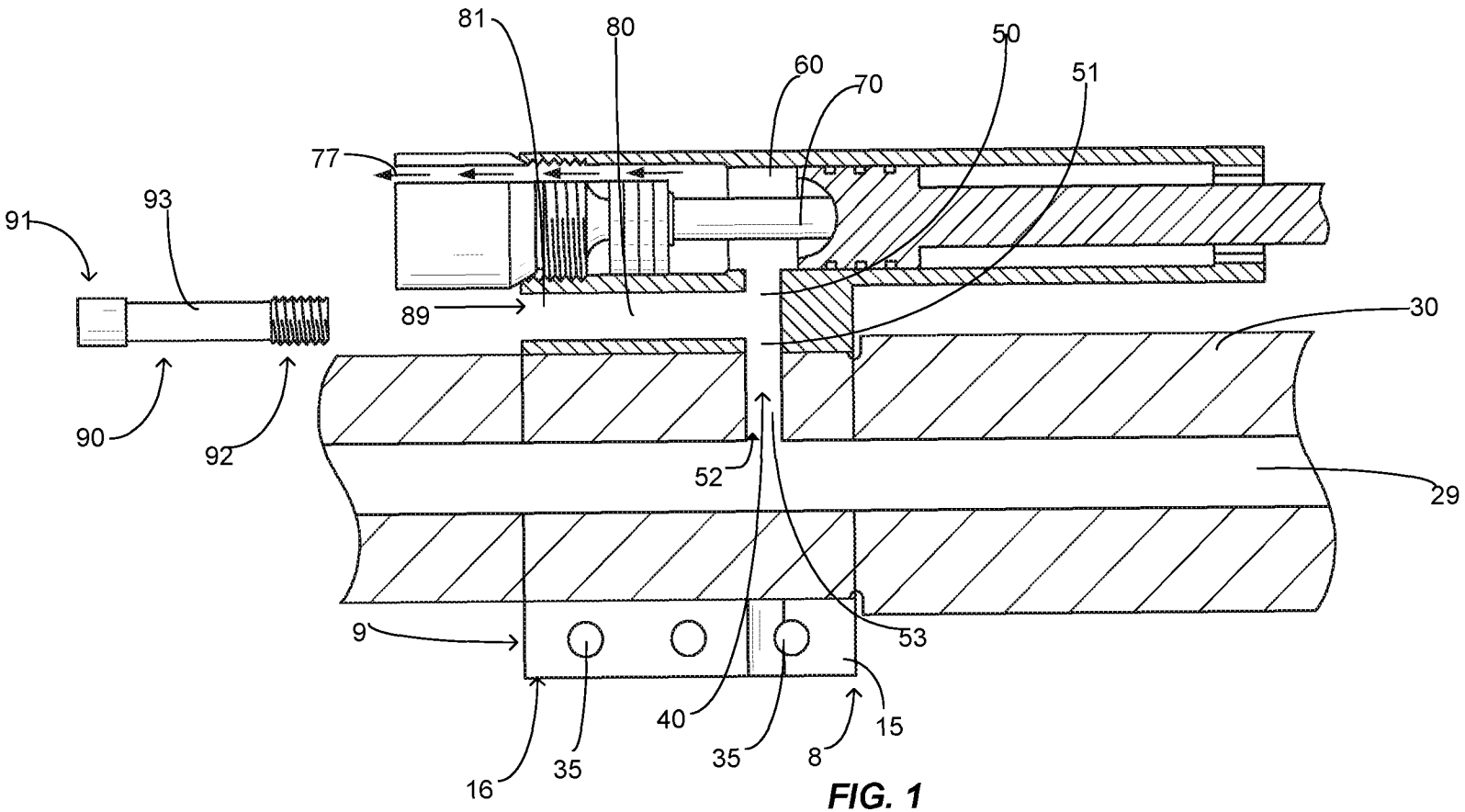
FIG. 1 is a diagrammatic side view of the present invention.

Referring now to the drawings submitted herewith, wherein various elements depicted therein are not necessarily drawn to scale and wherein through the views and figures like elements are referenced with identical reference numerals, there is illustrated a firearm impingement block with adjustable gas flow control member 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Figure 2:
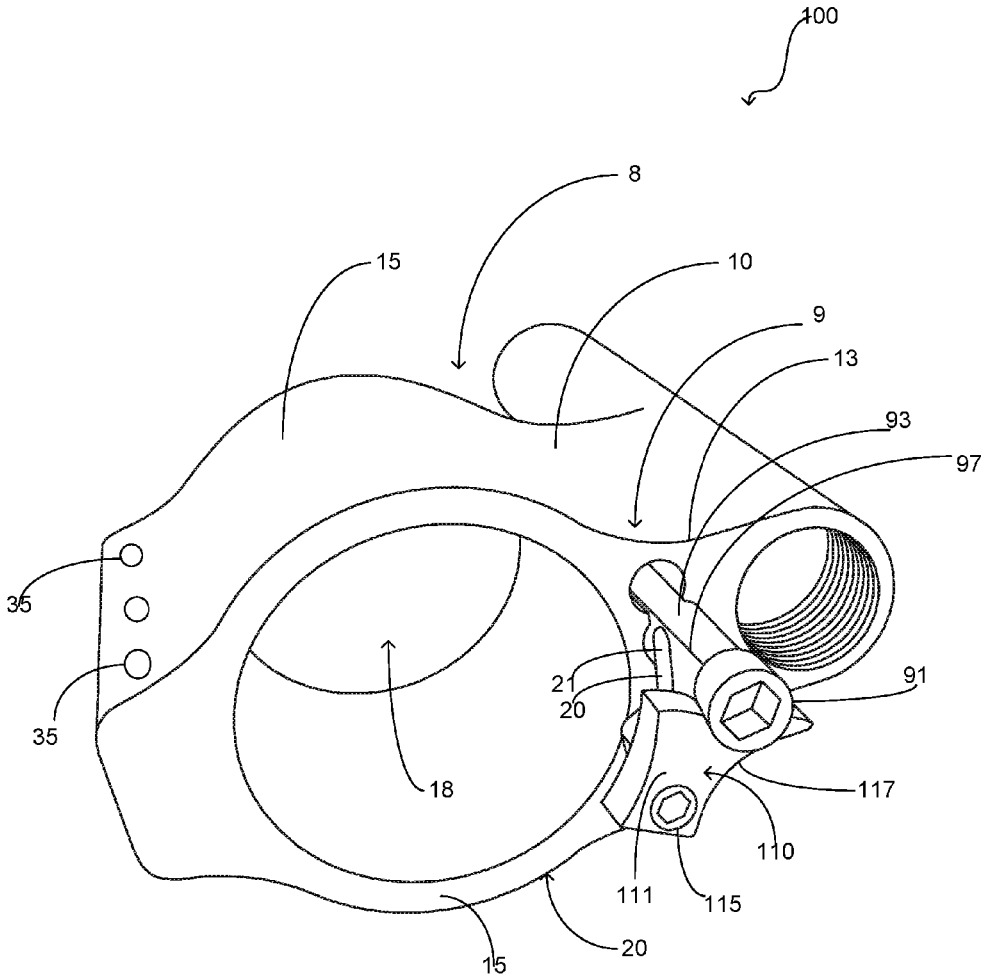
FIG. 2 is an exterior view of the impingement block of the present invention.

Referring in particular to FIGS. 1 and 2 herein, the firearm impingement block with adjustable gas flow control member 100 is illustrated therein. The firearm impingement block with adjustable gas flow control member 100 includes gas block 10 that is integrally formed with barrel-mating sleeve 15. Gas block 10 includes first end 9 and second end 8. The gas block 10 and barrel-mating sleeve 15 are integrally formed utilizing suitable techniques and are manufactured from a suitable durable material such as but not limited to metal. The barrel-mating sleeve 15 is manufactured similarly to conventional barrel sleeves of existing impingement systems wherein the barrel-mating sleeve 15 includes two opposing semi-circular portions 20 that form a passage 18 that is operable to receive a barrel assembly 30 of a firearm therethrough. The barrel-mating sleeves 15 are secured to barrel assembly 30 utilizing fasteners 35 proximate lower edge 16 of barrel-mating sleeve 15. The barrel-mating sleeve 15 is surroundably mounted to a barrel assembly 30 of a firearm wherein the gas block line port 50 bored within the gas block 10 is in axial alignment with gas vent tube 40. Gas vent tube 40 includes hollow passage 53 having openings 51, 52 on opposing ends thereof. Gas vent tube 40 is bored through barrel assembly 30 using conventional techniques and facilitates the fluid communication between the barrel assembly 30 and the gas block 10.

As a round of ammunition is fired and passes through the passage 29 of the barrel assembly 30, associated gas also passes through the passage 29 and a portion of the gas propagates into the gas vent tube 40. Gas entering the gas vent tube 40 facilitates the operation of the firearm impingement block with adjustable gas flow control member 100. Ensuing the firing of a round of ammunition, gas flows from the gas vent tube 40 into the gas block line port 50 and subsequently into the chamber 60. As gas flows into the chamber 60, the increase in pressure within the chamber 60 drives the piston rod 70 rearward wherein the piston rod 70 will operably engage with a conventional bolt carrier of a the firearm to which the firearm impingement block with adjustable gas flow control member 100 is operably coupled in order to cycle the bolt carrier to retrieve another round of ammunition into the firing chamber. During the passage of gas from the passage 29 into the gas block line port 50, the expansion of the gas and the temperature thereof creates excessive pressure and wear on the gas block 10. In order to control the diversion of gas flow into a first direction and a second direction wherein the first direction of gas flow is operable to cycle the piston rod 70 as described herein and the second direction of gas flow exits the gas block 10 via a port 77. While port 77 is illustrated herein in a particular position that discharges the gas flow in a direction opposite the piston rod 70, it is contemplated within the scope of the present invention that the port 77 could be formed either in a single or both sides of the gas block in addition to and/or in conjunction with the port 77 as illustrated herein.

The adjustable gas flow control member 90 is releasably secured in channel 80. Adjustable gas flow control member 90 is manufactured from a suitable durable material such as but not limited to metal and includes a first end 91 and a second end 92, wherein the second end is journaled into opening 89. First end 91 is configured to so as to be engaged by a tool such as but not limited to an allen wrench so as to facilitate the rotation of the adjustable gas flow control member 90. Second end 92 includes integral threads that are operable to facilitate the releasable securing of the adjustable gas flow control member 90 within channel 80. A shaft 93 is intermediate the first end 91 and second end 92. The shaft 93 is formed in a shape so as to precisely control the rotation amount thereof. More specifically but not by way of limitation, the shaft 93 is square in shape so as to provide incremental rotational movement of the adjustable gas flow control member 90. While in the preferred embodiment the shaft 93 includes four sides, it is contemplated within the scope of the present invention that the shaft 93 could be manufactured having three sides or more than four side so as to provide various incremental rotational movement.

As shown in particular in FIG. 2 herein, the shaft 93 has biased thereagainst a keeper 20. The keeper 20 functions to bias against the shaft 93 with sufficient force so as to control the incremental rotational movement of the adjustable gas flow control member 90 as described herein. The keeper 20 is manufactured from a suitable durable resilient material such as but not limited to metal and is planar in manner. The keeper 20 is releasably secured to a mounting member 110 wherein the second end (not pictured herein) of the keeper 20 is journaled into the mounting member 110 and secured therein with fastener 115. The first end 21 of the keeper 20 is positioned such that the first end 21 is extending to or beyond the distal edge 97 of the shaft 93. The position ensures that the keeper 20 is biased against the shaft 93 with sufficient force so as to control the rotation and ensure fixed positioning of the adjustable gas flow control member 90. While the keeper 20 is illustrated and discussed herein as being releasably secured with fastener 115, it is contemplated within the scope of the present invention that the keeper 20 could be secured to the mounting member 110 utilizing numerous suitable techniques.

The mounting member 110 includes a body 111 that is integrally secured to the gas block 10 utilizing suitable durable techniques. Mounting member 110 is secured to gas block 10 adjacent to end 81 of channel 80. The mounting member 110 further includes upper edge 117 that is arcuate in shape. The shape of the upper edge 117 is designed so as to be flush with edge 13 in order to prevent obstruction of any other element of the firearm to which the firearm impingement block with adjustable gas flow control member 100 is operably coupled thereto.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A firearm impingement apparatus comprising:

a gas block, said gas block having at least one port facilitating the release of gas therefrom, said gas block having a first end and a second end;

a barrel-mating sleeve, said barrel mating sleeve being integrally formed with said gas block;

a gas block line port, said gas block line port having a hollow passage, said gas block line port extending through said gas block, said gas block line port being in axial alignment with a vent tube of a barrel of a firearm;

a channel, said channel being bored in said gas block, said channel extending from said first end of said gas block to said gas block port line, said channel being perpendicular with respect to said gas block line port;

a gas flow control member, said gas flow control member being rotatably secured within said channel of said gas block, said gas flow control member having a portion thereof being operably coupled to said gas block line port, said gas flow control member having a first end and a second end, said first end of said gas flow control member extending outward from said first end of said gas block, said gas flow control member having a shaft intermediate said first end and said second end, said shaft having at least three sides; and a keeper, said keeper being mounted to said first end of said gas block, said keeper being secured such that a portion thereof is biased against said shaft of said gas flow control member, said keeper being operable to provide incremental controlled rotation of said gas flow control member.

2. A firearm impingement apparatus comprising:

a gas block, said gas block having at least one port facilitating the release of gas therefrom, said gas block having a first end and a second end, said gas block further including a gas block line port, said gas block line port having a hollow passage, said gas block line port extending through said gas block, said gas block line port being in axial alignment with a vent tube of a barrel of a firearm, said gas block further including a channel, said channel operably intersecting said gas block line port, said channel being perpendicular to said gas block line port, said channel having a first end and a second end, said channel extending outward towards said first end of said gas block, said channel having an opening proximate said first end of said gas block;

a barrel-mating sleeve, said barrel mating sleeve being integrally formed with said gas block, said barrel-mating sleeve operable to secure the firearm impingement apparatus to a barrel of a firearm;

a gas flow control member, said gas flow control member being rotatably secured within said channel of said gas block, said gas flow control member having a first end and a second end with a shaft intermediate therebetween, said gas flow control member movable so as to position said second end into said gas block line port;

a mounting member, said mounting member being secured to said first end of said gas block, said mounting member being adjacent said opening of said channel; and a keeper, said keeper being planar in manner having a first end and a second end, said second end of said keeper being releasably secured into said mounting member, said keeper extending outward from said mounting member so as to be positioned such that a portion thereof is biased against said shaft of said gas flow control member, said keeper being operable to provide incremental controlled rotation of said gas flow control member.

* * * * *